US006315742B1

(12) United States Patent
Howard

(10) Patent No.: US 6,315,742 B1
(45) Date of Patent: Nov. 13, 2001

(54) DEVICE FOR SELF MASSAGE, ACUPRESSURE SELF CARE AND ACUPRESSURE MERIDIAN STIMULATION

(76) Inventor: Christian Howard, 36038 Elaine Way, Yucaipa, CA (US) 92399

( * ) Notice: Subject to any disclaimer, the term of this patent is extended or adjusted under 35 U.S.C. 154(b) by 0 days.

(21) Appl. No.: 09/300,247

(22) Filed: Apr. 20, 1999

Related U.S. Application Data

(60) Provisional application No. 60/082,410, filed on Apr. 20, 1998.

(51) Int. Cl.[7] ..... A61H 15/00

(52) U.S. Cl. ..... 601/125; 601/128; 601/135

(58) Field of Search ..... 601/115, 116, 601/118, 122, 123, 125, 128, 129, 131, 135, 22, 28, 29

(56) References Cited

U.S. PATENT DOCUMENTS

| | | | |
|---|---|---|---|
| 1,572,794 | | 2/1926 | Hamilton . |
| 2,156,839 | | 5/1939 | Buffalow . |
| 2,619,957 | | 12/1952 | Hague . |
| 3,756,224 | * | 9/1973 | Laymon . |
| 4,374,519 | | 2/1983 | Stauft . |
| 4,688,556 | | 8/1987 | Keller, Jr. . |
| 4,796,616 | | 1/1989 | Panahpour . |
| 4,832,006 | | 5/1989 | Kirsch . |
| 5,352,188 | | 10/1994 | Vitko . |

FOREIGN PATENT DOCUMENTS

| | | | | |
|---|---|---|---|---|
| 569104 | * | 3/1961 | (BE) | 601/122 |
| 465348 | * | 1/1992 | (EP) | 601/125 |

* cited by examiner

*Primary Examiner*—Danton D. DeMille

(57) ABSTRACT

A massaging device is adapted for effective back massage especially along the spine. A flat platform supports a number of rotating wheels positioned for contact with separated muscle groups and acupressure points. The wheels are of a rubber material of such hardness as to allow a person to lay down onto the device without pain but to receive an effective pressure massage in the tissues of the back without bruising. With the device centered on the spine and with its wheels spaced on either side of the spine the individual may move along the ground while receiving a deep therapeutic massage. A pair of close spaced rollers are positioned relative to the wheels for massaging the tissues of the neck.

2 Claims, 5 Drawing Sheets

DEVICE FOR SELF MASSAGE, ACUPRESSURE SELF CARE AND ACUPRESSURE MERIDIAN STIMULATION

This application claims the filing date of a previously filed provisional application having Ser. No. 60/082,410 and an assigned filing date of Apr. 20, 1998 and which contains subject matter substantially the same as that described and claimed in the present application.

BACKGROUND OF THE INVENTION

1. Field of the Invention

This invention relates generally to devices used for manual massage, and more particularly to a device constructed with a plurality of wheels positioned advantageously for accomplishing the objectives of the invention.

2. Description of Related Art

The following art defines the present state of this field:

Hamilton, U.S. Pat. No. 1,572,794 describes a massage device comprising a plurality of grooved rollers of different sizes and alternately arranged, the rollers being shaped to straddle the spine, means for retaining the rollers in spaced relation to one another, a table on which the rollers travel, and means attached to the table for guiding the movement of the rollers on the table.

Buffalow, U.S. Pat. No. 3,156,839 describes a massage device comprising a vibratory arm, a socketed ball applicator on the arm, and rollers associated with the applicator for travel over the body, the axis of rotation of the rollers being in the plane of vibration of the arm for cooperation with the ball applicator in the massaging operation.

Hague, U.S. Pat. No. 2,619,957 describes a roller device comprising in combination a rigid hub having an axial opening for the reception of an axle, the hub having peripheral grooves adjacent its ends, a resilient tubular ring in each groove, an elastic tube enveloping the hub and the tubular rings, and means for securing the ends of the elastic tube to the ends of the hub.

Stauft, U.S. Pat. No. 4,374,519 describes a spinal massage device comprising four rubber balls mounted in pairs on opposite sides of a linking plate such that the balls are rotated along a supporting surface, such as the floor, as the user lies with his spine on the device and then moves his back parallel to the floor.

Keller, Jr., U.S. Pat. No. 4,688,556 describes one or more yielding oblate spheroids rotatably held in a support frame that can roll on a support surface while the user of the device is in a prone position and has his or her spine resting on the rolling oblate spheroid or spheroids which gently and effectively massage the spine. The device is propelled by the legs of the user and therefore provides exercise. The tapered ends of the massage elements are releasably socketed in cup elements held on rotation al bearings of the support frame.

Panahpour, U.S. Pat. No. 4,796,616 describes a massaging apparatus having a plurality of balls mounted in laterally and longitudinally spaced openings in a carrier, wherein the balls are made of a yieldable, compressible material and are positioned in the openings so that a portion of each ball projects beyond the generally plannar plates of the carrier, and the balls are mounted so as to enable the balls to be compressed and freely rotated in all directions when one projecting ball portion is in contact with a user's body and the other projecting ball portion is in contact with the floor or other relatively rigid surface.

Kirsch, U.S. Pat. No. 4,832,006 describes an apparatus for physical fitness, reeducation and health improvement which is designed to apply a deep and systematic massage to the body through the use of rollers specifically adapted to the morphology of the different regions of the body. This apparatus has a support through which the optimal elevation for each roller can be selected. The rollers are composed of treatment wheels and spacers, which enables their application to touch at the same time, the superficial and deep muscles, the tendons and ligaments of the joints concerned.

Vitko, U.S. Pat. No. 5,352,188 describes a small lightweight yet strong frame, housing multiple flexible axles which in turn support foam rubber roller balls which roll about an axis creating massage, intersegmental traction, trigger point therapy and active exercise to the back of the user. These axles are made more efficient by the placement of bushings where they are contained by frame. Foam rubber balls contain sleeves, which promote free rotation. Neck roller balls are also used to facilitate optional concomitant neck and back treatment. A headrest is provided for comfort and multiple tension adjustments are provided for varying resistance to glide.

The prior art teaches similar manual massage devices with multiple wheels and rollers in various physical layouts and arrangements. However, the prior art does not teach that such a device may be advantageously designed for laying on in order to achieve a deep massage without bruising and which is able to massage multiple muscle groups, multiple spinal meridians and multiple acupressure points simultaneously. The present invention fulfills these needs and provides further related advantages as described in the following summary.

SUMMARY OF THE INVENTION

The present invention teaches certain benefits in construction and use which give rise to the objectives described below.

The present invention provides a massaging device adapted for effective back massage especially along the spine. A flat platform supports a number of rotating wheels positioned for contact with separated muscle groups spine meridians and acupressure points. The wheels are of a rubber material of such hardness as to allow a person to lay down onto the device without pain but to receive an effective pressure massage in the tissue of the back. With the device centered on the spine and with its wheels spaced on either side of the spine the individual may move along the ground while receiving a deep therapeutic massage.

A primary objective of the present invention is to provide a manual massage device having advantages not taught by the prior art.

Another objective is to provide such a device enabled for supporting the weight of an individual such that a deep therapeutic massage is provided by rolling on the device along a floor or other support surface.

A further objective is to provide such a device enabled for massage of the neck and back muscles simultaneously and separate back muscle groups simultaneously and to stimulate both spinal meridians and acupressure points simultaneously.

A still further objective is to provide such a device enabled for effective acupressure benefits.

A still further objective is to provide such a device enabled for hands-off massage.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
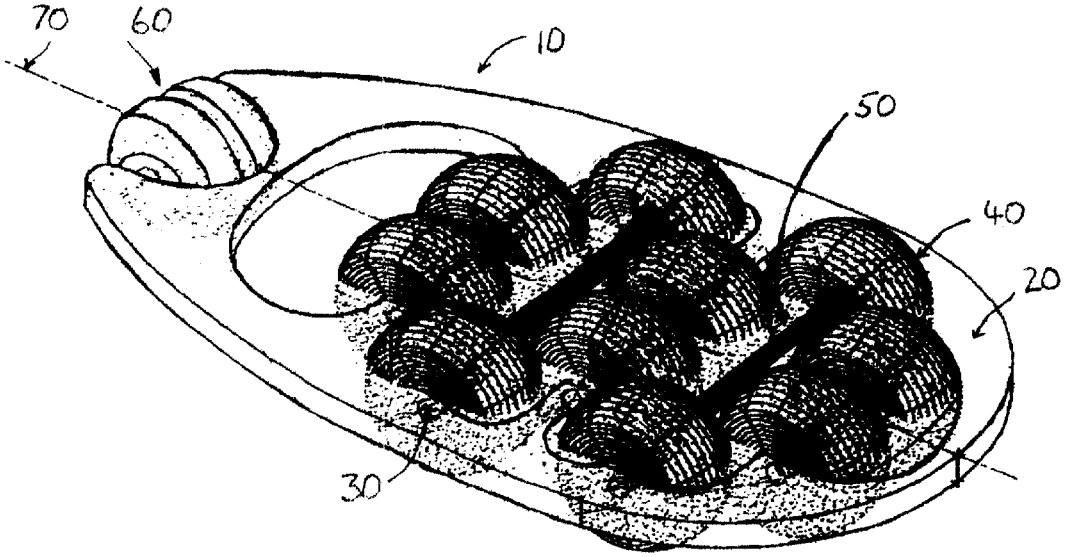
FIG. 1 is a perspective view of a preferred embodiment of the present invention.

The above described drawing figures illustrate the invention, an apparatus 10 for massaging a human (not shown). The apparatus 10 comprises a rigid, flat frame plate 20 of appropriate plastic, metal or wooden construction and provides an axle receiving means 30 comprising a plurality of individual axle insertion slots arranged in a beneficial and particular spacing as will be described hence. Further, the apparatus provides a rolling massaging means 40, made of a rubber or thermoplastic material, comprising a plurality of individual wheels and a massaging means supporting means 50 of a rigid material such as metal or plastic, comprising a plurality of individual axles. The massaging means supporting means 50 joins the rolling massaging means to the frame plate 20 at the axle receiving means 30 so that the rolling massaging means 40 is free to rotate. The individual wheels are particularly and effectively positioned and spaced apart such that with the apparatus 10 positioned for placement of the wheels in contact with a human back, pressure may be applied through the rolling massaging means 40 simultaneously to either multiple acupressure points, or all four of the acupressure meridians or multiple muscle groups. In a preferred embodiment, the present invention inventively further provides a pair of close-spaced wheels 60 which is also adapted for rotational engagement and positioning in the frame plate 20, particularly, such that with the apparatus placed for positioning the pair of close-spaced wheels 60 in contact at the base of the skull the rolling massaging means 40 is advantageously and simultaneously positionable for contact with the shoulder muscles. From the figures it is clear that the wheels are positioned for rolling along the spine with the spine positioned at the symmetrical center of the wheels, see reference numeral 70 in FIG. 1, and with the close-spaced wheels 60 positioned most closely to the spine itself. Such rolling action which may be self applied or other applied may be made to or on any part of the body, legs, head or arms. It may be applied by hand or the apparatus 10 may be placed between the back and a wall or floor surface and some or all of the body weight pressed against the apparatus 10. The present invention is most valuable and has been designed inventively to take advantage of the therapeutic properties of massage on and around the spine. Inventively, the individual wheels are spaced at two highly valuable positions relative to the spine. First of all, the preferred placement of the wheels is symmetrical relative to the spine. Second, the wheels are positioned at between 1.25 and 1.5 inches lateral to the centerline of the spine and also between 2.75 and 3 inches relative to the spine in a bilateral manner. This spacing is in accordance with medical research which shows that along each side of the spine and running in parallel thereto a series of therapeutic acupressure points exist defining an acupressure meridian. The wheel spacing defined above has been discovered to provide unexpected benefit and therapeutic relief to those using the apparatus in this manner. Clinical tests tend to confirm this result. The text; *Medical Advisor*, published by Time-Life Publicatons provides substantiation to the above statements. Inventively, the individual wheels are color coded for indication of material hardness. It has been discovered that a hardness of between 20 and 30 durometer results in the ability to utilize the apparatus for optimal effectiveness in massage without bruising the flesh when the apparatus is loaded by the full weight of the torso of the individual receiving the massage. Individual body weight a body surface fat content determines the proper selection of material harness within the range of hardnesses defined. When the body weight is too great, pain and bruising occurs. When the body weight is too little, a therapeutic deep massage and proper acupressure results are not optimized. However, it has been discovered that with ten wheels arranged as shown in the figures, with harness in the range stated above, and with each wheel having an individual wheel width of approximately 1¼ inches optimal results may be obtained by most individuals.

Figure 2:
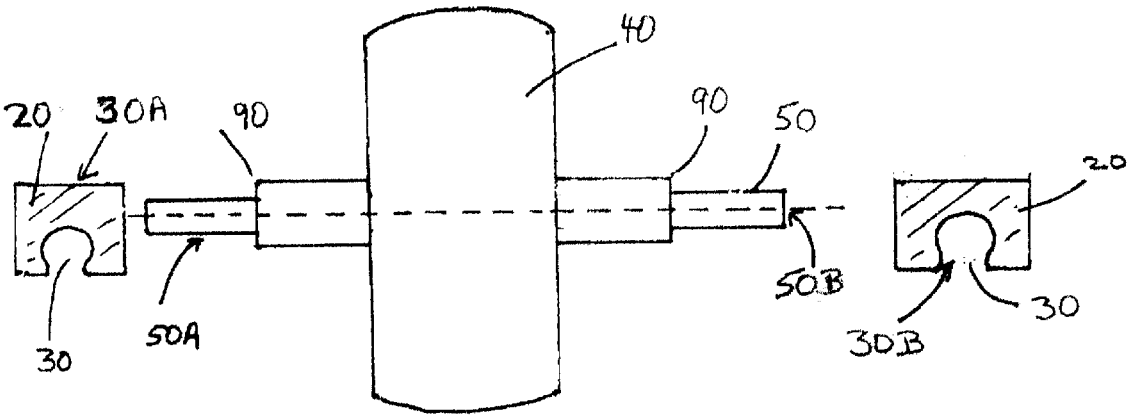
FIG. 2 is a side elevational view of a rolling massaging means and its mounting thereof.
Figure 3:
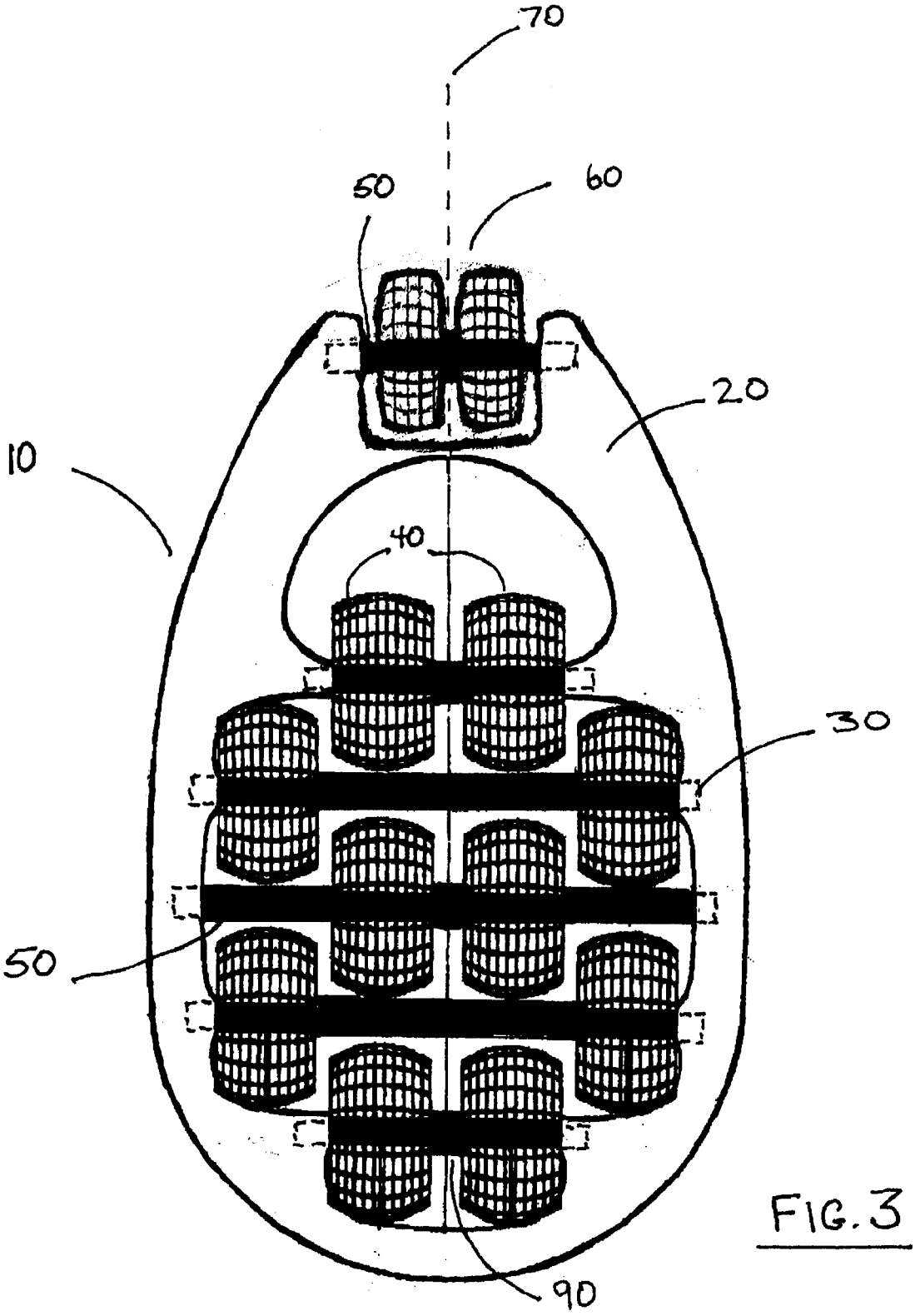
FIG. 3 is a plan view thereof.
Figure 4:
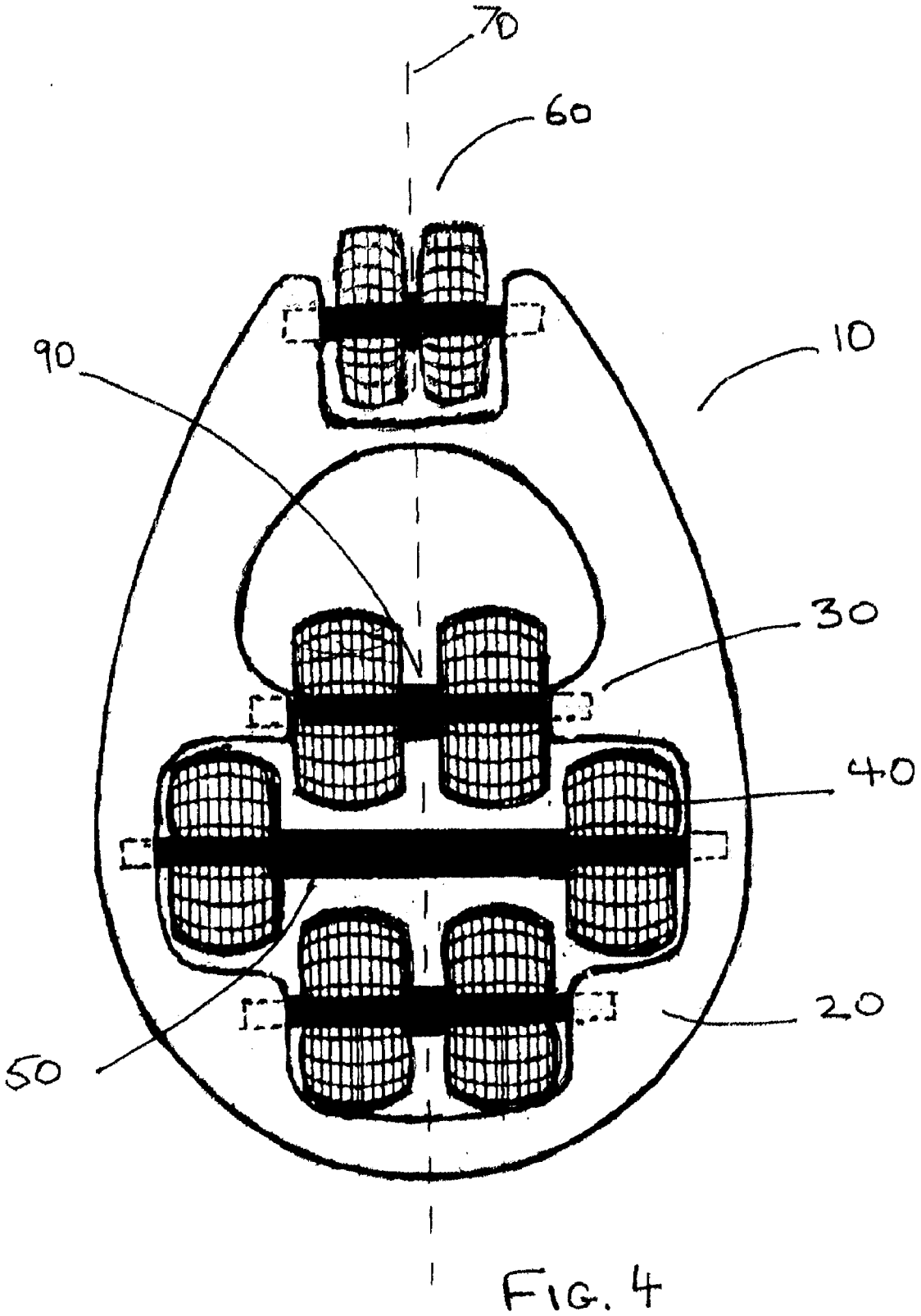
FIG. 4 is a plan view of an alternate embodiment of the invention adapted for an individual having a light body weight or a youth.
Figure 5:
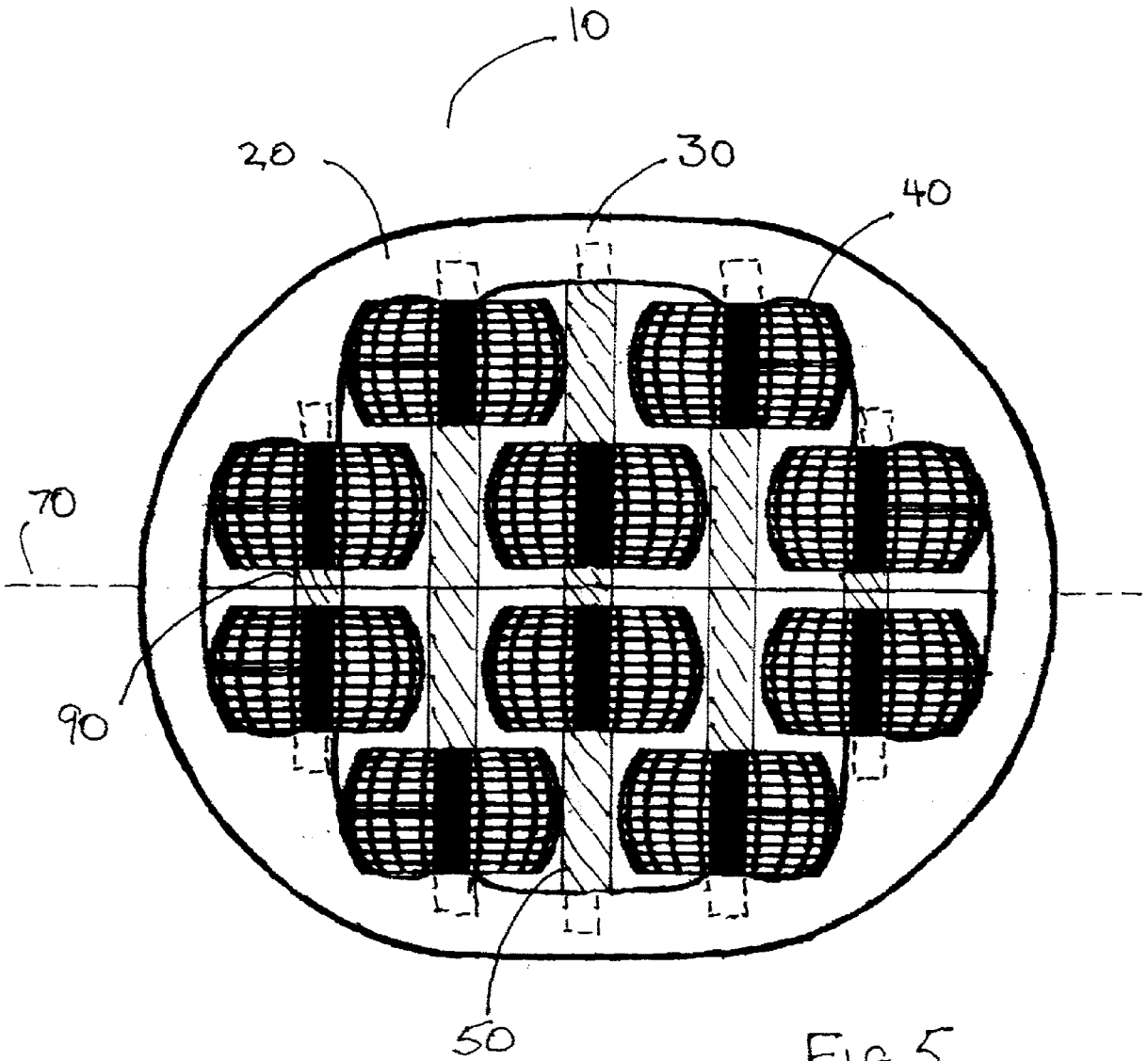
FIG. 5 is a plan view of a further alternate embodiment of the invention without a neck massage wheel pair.
Figure 6:
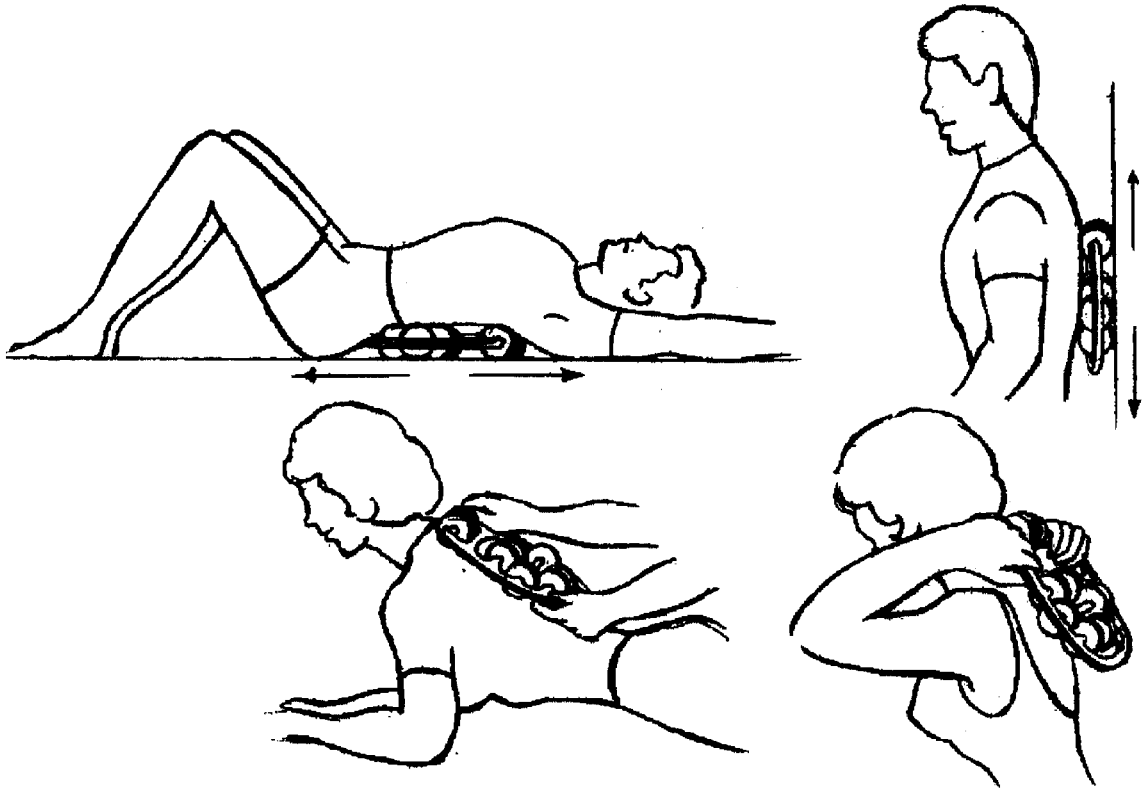
Figure 6:
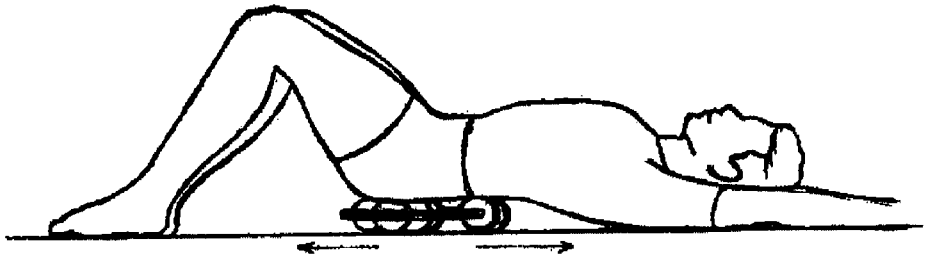

Now, as to the mounting of the individual wheels; each of the wheels is first mounted onto an axle of the massaging means supporting means 50 by pressing the axle into a wheel bushing of the wheel. Positioning ridges 90 are used to assure correct lateral positioning of the wheels. The positioning ridges 90 enable the exact placement of the wheel laterally and assures its consistent position during use. The axle receiving means 30 is preferably enabled for sliding one end 50A of the axle into a first part 30A preferably a blind hole of axle receiving means 30 as shown at the left in FIG. 2. Next, the other end 50B of shaft 50 is pressed laterally into a second part 30B of receiving means 30. To accomplish this, second part 30B is configured as shown in FIG. 2. When mounted in place, rolling massaging means 40 and massaging means supporting means 50 rotate together freely within axle receiving means 30.

The close-spaced wheels 60, due to narrow profile and relatively closer spacing, preferably ¼ of an inch between the two wheels, enables effective massage and acupressure therapy along the neck where the spine narrows when applied in the same manner as defined above. The close-spaced wheels 60 is preferably made of the same materials as the other wheels and is mounted to the frame plate 20 in accordance with the above description.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A hand-held frame with rollers for massaging the acupressure meridians and the acupoints located thereon including the 16 acupoints at the base of the spine comprising:

a frame consisting of only a single frame plate having a length and a width with a longitudinal center line;

a pair of first rollers for massaging the base of the skull, said first rollers are mounted for rolling engagement at one end of the frame plate and extending beyond the frame plate through an opening therein;

a second opening in the frame plate spaced inwardly from the first rollers for allowing the user's hand to pass therethrough forming a handle;

a plurality of second rollers spaced on the opposite end of the second opening from the first rollers, each of the second rollers having a width of approximately 1¼ inches providing a wide massaging surface area, said plurality of second rollers including pairs of rollers arranged in rows, said pairs of rollers spaced symmetrically from the longitudinal center line;

wherein the arrangement of the second rollers allows effective treatment of the 16 acupoints at the base of the spine simultaneously, the arrangement also allows proper massaging of associated muscles along the acupressure meridians and contact with acupoints located thereon.

2. The hand-held frame of claim 1 wherein, the rollers are made of a material with a shore hardness between 20 and 30 to apply proper pressure for optimal effectiveness.

* * * * *